US005287996A

United States Patent [19]

Uhlig

[11] Patent Number: 5,287,996

[45] Date of Patent: Feb. 22, 1994

[54] LIQUID SOAP DISPENSER WITH BUILT-IN PUMP

[75] Inventor: Bernd Uhlig, Frankfurt am Main, Fed. Rep. of Germany

[73] Assignee: CWF Chemie Frankfurt GmbH, Maintal, Fed. Rep. of Germany

[21] Appl. No.: 891,657

[22] Filed: May 29, 1992

[30] Foreign Application Priority Data

May 31, 1991 [DE] Fed. Rep. of Germany ... 9106675[U]

[51] Int. Cl.[5] ..... B67D 5/58

[52] U.S. Cl. ..... 222/189; 222/173; 222/321

[58] Field of Search ..... 222/153, 321, 189, 385, 222/183, 173

[56] References Cited

U.S. PATENT DOCUMENTS 4,420,096 12/1983 Kirk, Jr. ..... 222/321 X
4,582,227 4/1986 Kanfer .
4,776,498 10/1988 Maerte et al. ..... 222/321

FOREIGN PATENT DOCUMENTS 3420678 12/1985 Fed. Rep. of Germany .
746400 7/1934 France .

*Primary Examiner*—Gregory L. Huson

*Attorney, Agent, or Firm*—Kurt Kelman

[57] ABSTRACT

A liquid soap dispenser suitable for installation on a mounting surface comprises a socket including an upper part having an upper edge, a tubular piece, the socket and the tubular piece being mountable on the mounting surface. A tubular pump including an actuating rod is housed in the tubular piece, the tubular pump and actuating rod defining a conduit for the liquid soap and being axially reciprocable through a pumping stroke between a highest and a lowest position. The actuating rod extends through an annular gap and a soap dispensing nozzle having a cap fits over the upper socket part and has a lower edge facing the upper socket part, the nozzle cap and the upper socket part defining in all stroke positions an annular gap concentrically surrounding the annular gap through which the actuating rod extends. The nozzle cap defines an annular recess facing the upper edge of the upper socket part, the upper edge and the lower edge extending substantially in the same plane when the actuating rod is in the highest position, and the external diameter of the upper socket part being slightly smaller than the diameter of annular recess at least along a length corresponding to the length of the stroke of the actuating rod whereby the upper socket part may be slid into the annular recess.

7 Claims, 3 Drawing Sheets

LIQUID SOAP DISPENSER WITH BUILT-IN PUMP

BACKGROUND OF THE INVENTION

1. Field of the Invention

The present invention relates to a liquid soap dispenser with a built-in pump assembly for small bathrooms, such as used in airplanes, railroad cars and buses, and which are installed on a mounting surface adjacent a wash basin.

2. Description of the Prior Art

Known liquid soap dispensers of this type comprise a socket having an upwardly facing annular gap receiving a pump actuating rod. A head piece rests on the upper end of the actuating rod and a soap dispensing nozzle in the form of a tube having a downwardly bent free end radially projects therefrom. Repeated pressing of the head piece causes the pump to be actuated and to pump the liquid soap out of a storage container so that it is dispensed from the free end of the nozzle. This type of soap dispenser serves its purpose but, aside from its none too attractive appearance, it has the disadvantage that the annular gap between the actuating rod and the socket is totally uncovered at the top so that it is accessible to dirt and germs, which tendency is further increased by the fact that the pressure in the storage container is equalized through the annular gap, i.e. dirty particles in the ambient atmosphere are regularly sucked into the gap. Furthermore, dirt clinging to the projecting portion of the actuating rod is also carried into the annular gap by the reciprocating pump actuating rod movements.

The soap dispenser disclosed in French patent No. 746,400 is not suitable for the indicated use since it forms a unit with the storage container and, therefore, cannot be installed on a surface next to a wash basin because the soap dispensing nozzle with the head piece for actuation of the pump does not form a unit and is arranged substantially lower than the head piece.

The same holds for the soap dispenser disclosed in published German patent application No. 3,420,678 which also cannot be installed on a surface next to a wash basin.

The soap dispenser disclosed in U.S. Pat. No. 4,582,227 is designed for installation in a wall and requires a special holder whereon the storage container and the soap dispenser is pivotally mounted. The head piece for actuating the pump and the nozzle form a unit and the annular gap is also completely uncovered on top.

SUMMARY OF THE INVENTION

The object of this invention is to improve a soap dispenser of the first-described type so that the required annular gap and the projecting part of the pump actuating rod is covered, i.e. is not directly and freely accessible but is protected, and the flow of the ambient air sucked into the storage container by the pumping action to equalize the pressure therein is deflected.

Such a soap dispenser is comprised of a socket and a tubular piece received therein and locked in position with the socket on a mounting surface. A tubular pump is mounted in the tubular piece and comprises an actuating rod forming a soap delivery conduit and being axially reciprocable between a highest and a lowest position. A soap dispensing nozzle is arranged on the pump actuating rod.

According to the invention, the soap dispensing nozzle has a cap above the socket and fitting over an upper part of the socket, the cap defining an annular gap with the upper socket part, which is concentric with the annular gap through which the pump actuating rod passes, and the soap dispensing nozzle has an annular recess above and facing the socket, an upper edge of the socket in the highest position of the actuating rod extending substantially in the same plane as a lower edge of the nozzle and the diameter of the socket being slightly smaller than the diameter of the annular recess at least over a length corresponding to the length of the stroke of the actuating rod.

This construction according to the invention not only results in the annular gap but also in the actuating rod being completely covered. Because of the cap-like fitting of the nozzle over the socket, the access to the annular gap is labyrinth-shaped so that it is largely protected from dirt, the actuating rod being equally protected and invisible. The socket as well as the nozzle part fitted thereover may be cylindrically shaped but an embodiment is preferred wherein the socket and an upper part thereof above a shoulder are frusto-conically shaped, as well as the wall of the annular recess and the outer wall of the nozzle which is free of a nozzle extension. The cones of the socket and the nozzle enclose the same angle. This produces larger spaces in the regions of connection between the nozzle and the socket and between the socket and the tubular piece.

To make the annular gap as narrow as possible, in addition to protecting it, the soap dispenser may be so constructed that the recess in the nozzle is inwardly defined by a cylindrical wall and the upper socket part has a recess, the outer wall of the recess and the cylindrical wall of the nozzle defining the annular gap in all operating positions.

Due to the sanitary importance of keeping the soap dispenser clean and facilitating its cleaning, and while its construction reduces the danger of its being polluted, a preferred embodiment provides a relatively high, two-part socket, i.e. a larger lower part and an upper part, the upper part being detachably supported in the lower part by means of extensions projecting below a shoulder between the upper and lower parts, and a soap dispensing nozzle also comprised of two interlocking parts.

The soap dispenser construction of the invention makes it possible to mount a suitable exchangeable dirt filter in the socket.

BRIEF DESCRIPTION OF THE DRAWING

A preferred embodiment of the invention will hereinafter be described in conjunction with the accompanying drawing wherein.

DESCRIPTION OF THE PREFERRED EMBODIMENT

Figure 4:
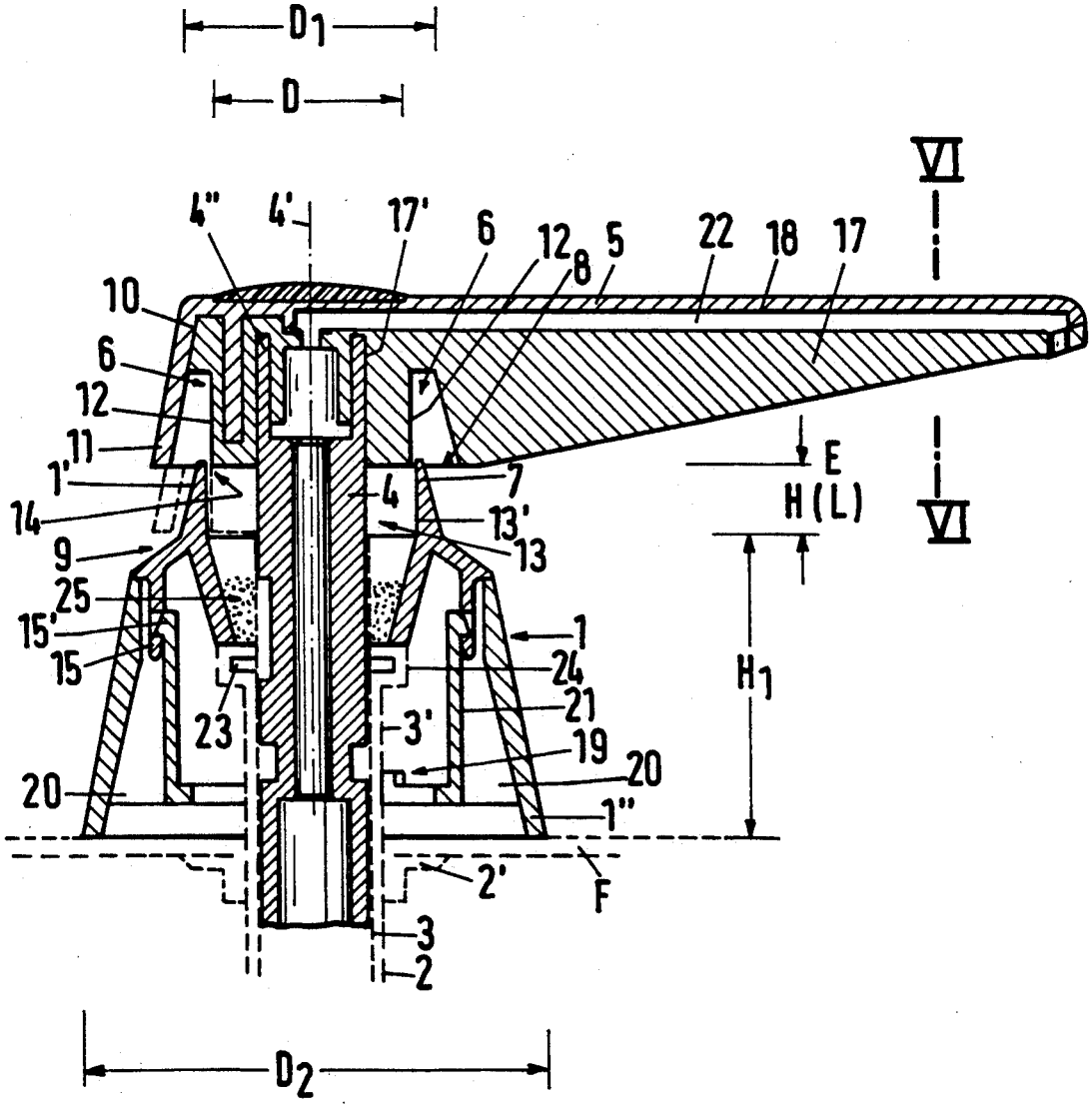
FIG. 4 is a sectional view along line IV—IV of FIG. 5.

Referring now to the drawing and most particularly to FIG. 4, the liquid soap dispenser is shown to comprise socket 1 wherein tubular piece 2 is received and locked in position with the socket on a mounting surface F. A small tubular pump 3 of conventional structure is mounted in tubular piece 2 and includes tubular actuating rod 4 which serves as soap dispensing conduit and has an axially adjustable stroke between a highest and a lowest position. Soap dispensing nozzle 5 is carried by the actuating rod and extends transversely to axis 4' of actuating rod 4. In this respect, reference is made to FIG. 7 which shows a conventional soap dispenser for purposes of comparison.

Height H1 of socket 1 corresponds at least to minimum diameter D thereof. Soap dispensing nozzle 5 has annular recess 6 extending above socket 1 and facing the socket, upper edge 7 of socket 1 extending substantially in the same plane E as lower edge 8 of the soap dispensing nozzle in the illustrated highest position of actuating rod 4. Outer diameter D of socket 1 is slightly smaller than diameter D1 of annular recess 6 at least along length L of the stroke H of the actuating rod.

Figure 5:
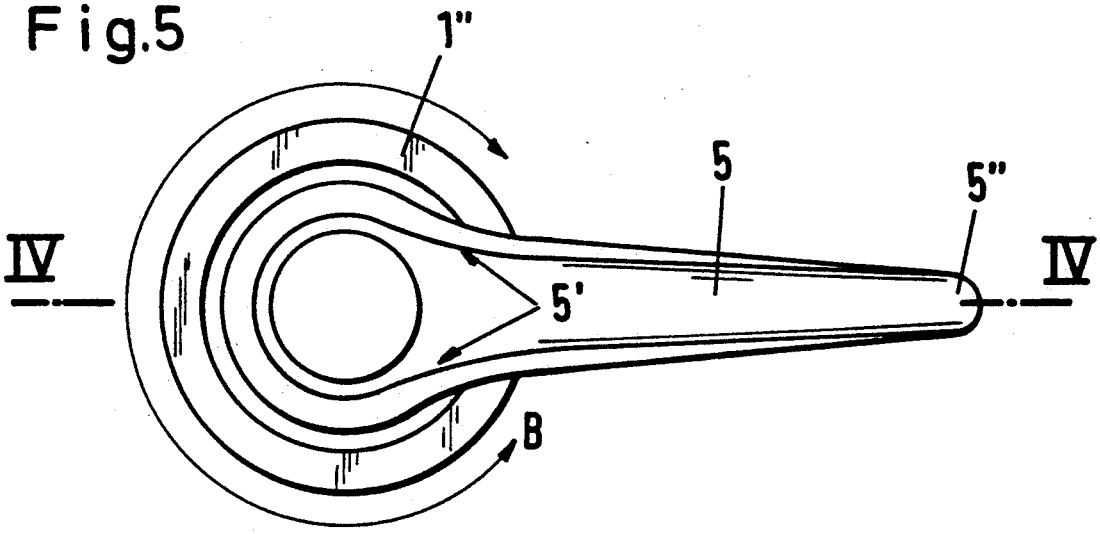
FIG. 5 is a top view of the soap dispenser.

While upper part 1' of socket 1 and a corresponding wall of recess 6 have been illustrated frusto-conical in FIG. 4, these portions (see FIG. 5) may also be cylindrical.

Figure 3:
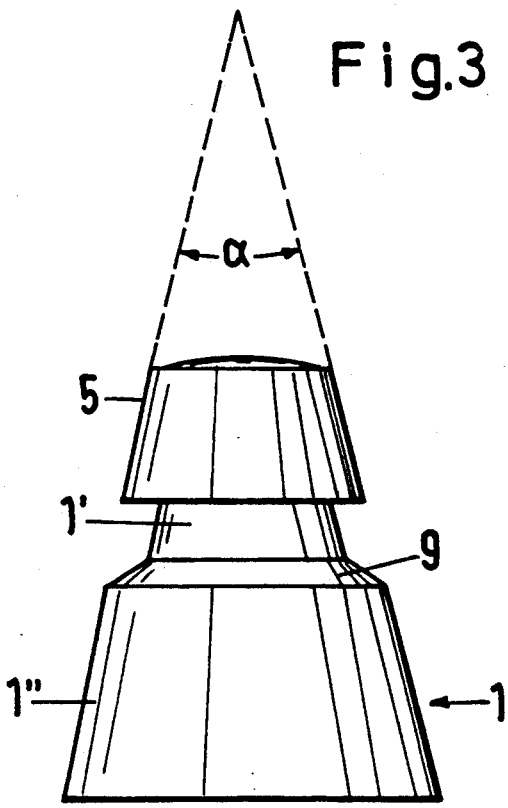
FIG. 3 is a rear view thereof.
Figure 7:
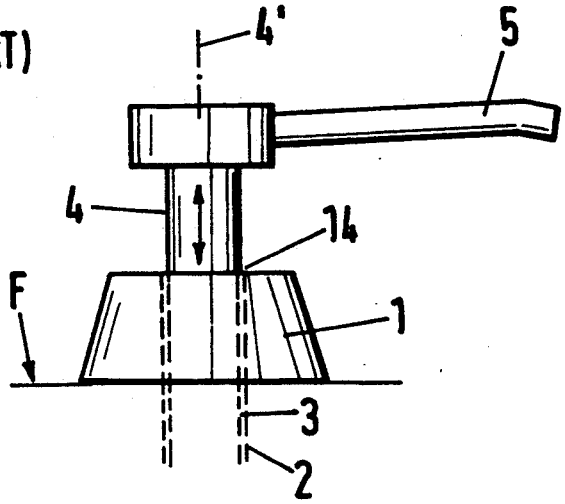
Fig.7 (PRIOR ART)
FIG. 7 is a side elevational view of a conventional soap dispenser for purposes of comparison.

In the embodiment shown in FIG. 4, upper part 1' of socket 1 is frusto-conical above shoulder 9 of the socket and inner wall 10 of annular recess 6 and outer wall 11 of region B of soap dispensing nozzle 5 which is free of nozzle extension 5' (see FIG. 5) are conformingly frusto-conical, angle $\alpha$ of the cones defined by socket 1 and nozzle 5 being identical, as shown in FIG. 3. Inner wall 12 of annular recess 6 is cylindrical and upper part 1' of socket 1 has recess 13 whose cylindrical wall 13' defines annular gap 14 with cylindrical inner wall 12 in all positions of actuating rod 4. The lowest position of nozzle 5 is shown in FIG. 4 in broken lines. Therefore, annular gap 14 and actuating rod 4 are fully covered in all positions of nozzle 5 and are never unprotected, as is the case in the conventional dispensers, as illustrated in FIG. 7.

Tubular piece 2 and screw 2' securing the same to mounting surface F are shown in broken lines since they have no direct relation to the soap dispenser structure of the present invention.

Socket 1 is comprised of upper part 1' and a larger lower part 1". In the preferred embodiment, upper part 1' is detachably supported in lower part 1". For this purpose, the upper socket part has extensions 15 projecting below shoulder 9 and support part 21 in the lower socket part has locking tabs 15' engaging openings 15" in upper socket part extensions 15.

Tubular piece 2 is connected to socket 1 by bayonet joint 19 which is arranged on support part 21 carried by radial ribs 20 extending inwardly from the socket. The housing of pump 3 has annular flange 23 for support on upper pot-shaped end 24 of tubular piece 2 so that pressure on nozzle 5 causes actuating rod 4 to be pressed down for dispensing the liquid soap through conduit 22. Annular flange 23 rests snugly in upper pot-shaped tubular piece end 24 so that soap dispensing nozzle 5 with pump 3 and socket 1 may be pulled off tubular piece 2 when socket 1 is detached from bayonet joint 19 by rotating the socket. Upper socket part 1' is also detachable from lower socket part 1" so that the interior of the socket may be readily accessible for cleaning.

Figure 1:
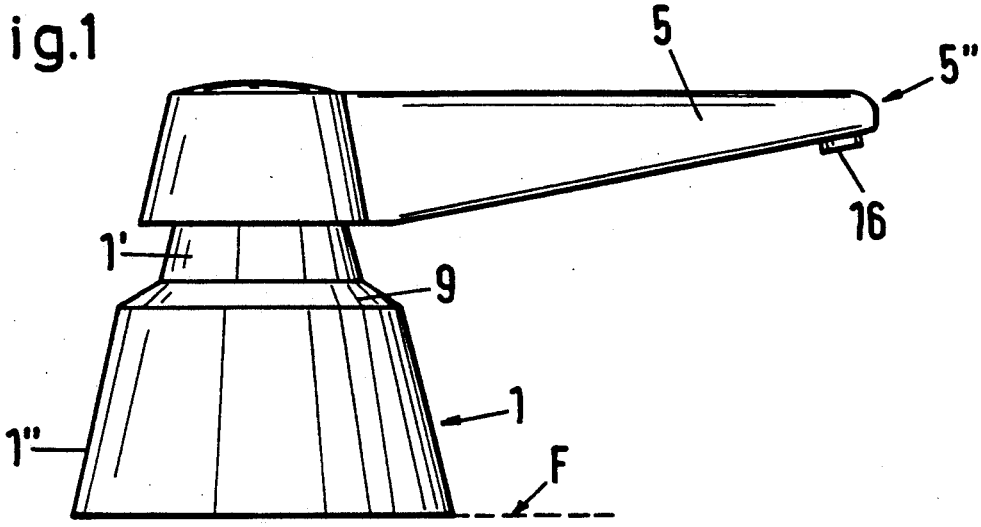
FIG. 1 is a side elevational view of the soap dispenser.
Figure 2:
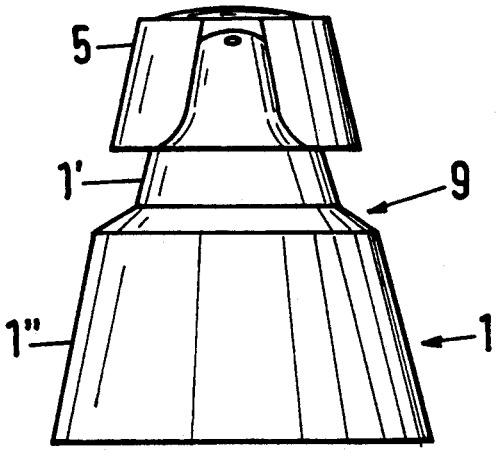
FIG. 2 is a front view thereof.
Figure 6:
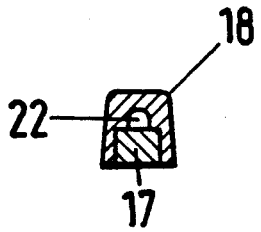
FIG. 6 is a sectional view along line VI—VI of FIG. 4.

Soap dispensing nozzle 5 is also comprised to two interlocking parts 17, 18. As shown in FIG. 1, a small cylindrical mouthpiece 16 is arranged in the dispensing end 5" of nozzle 5 so that the liquid soap drips out of the nozzle and a liquid flow to the socket is prevented. Nozzle part 17 snugly fits into nozzle part 18 (see FIG. 6), which has considerable manufacturing advantages with respect to forming dispensing conduit 22, and these nozzle parts can be taken apart so that the dispensing conduit may be cleaned if it becomes blocked. Nozzle part 17 has an annular groove 17' engaging the upper sleeve-shaped end 4" of actuating rod 4.

As shown in FIG. 4, a filter 25 may be detachably arranged in the free space defined by actuating rod 4 and upper socket part 1' below nozzle 5. Any air sucked into the non-illustrated container for the liquid soap through annular gap 14 between pump 3 and tubular piece 2 must pass through filter 25.

While the invention has been described as a liquid soap dispenser, it is not limited to such use.

What is claimed is:

1. A liquid soap dispenser suitable for installation on a mounting surface, which comprises a socket including an upper part having an upper edge, a tubular piece, the socket and the tubular piece being mountable on the mounting surface, a tubular pump including an actuating rod housed in the tubular piece, the tubular pump and actuating rod defining a conduit for the liquid soap and being axially reciprocable through a pumping stroke between a highest and a lowest position, the actuating rod extending through an annular gap, a soap dispensing nozzle having a cap fitting over the upper socket part and having a lower edge facing the upper socket part, the nozzle cap and the upper socket part defining in all stroke positions an annular gap concentrically surrounding the annular gap through which the actuating rod extends, the nozzle cap defining an annular recess facing the upper edge of the upper socket part, the upper edge and the lower edge extending substantially in the same plane when the actuating rod is in the highest position, and the external diameter of the upper socket part being slightly smaller than the diameter of annular recess at least along a length corresponding to the length of the stroke of the actuating rod whereby the upper socket part may be slid into the annular recess.

2. The liquid soap dispenser of claim 1, wherein the socket comprises a lower part having a diameter which exceeds that of the upper socket part.

3. The liquid soap dispenser of claim 2, comprising a shoulder between the lower and upper socket parts, the socket parts being frusto-conically shaped and having the same cone angle.

4. The liquid soap dispenser of claim 3, wherein the upper socket part has extensions projecting below the shoulder and detachably connecting the upper socket part to the lower socket part.

5. The liquid soap dispenser of claim 1, wherein the annular recess in the nozzle cap is bounded by a cylindrical inner wall, the annular gap through which the actuating rod extends is bounded by a cylindrical outer wall, the inner and outer walls defining the concentrically surrounding gap in all stroke positions.

6. The liquid soap dispenser of claim 1, wherein the soap dispensing nozzle is comprised of two detachably interlocking parts.

7. The liquid soap dispenser of claim 1, wherein the upper socket part and the actuating rod define a free space therebetween, further comprising an exchangeable air filter arranged in the free space.

* * * * *